US009003713B2

(12) United States Patent
Dries

(10) Patent No.: US 9,003,713 B2
(45) Date of Patent: Apr. 14, 2015

(54) MODULAR RAIL SYSTEM FOR SUSPENDING SLIDING DOORS AND SLIDING DOOR SYSTEM WITH USER ACCESSIBLE BRAKING/STOPPING ELEMENT

(75) Inventor: Rudi Dries, Schilde (BE)

(73) Assignee: Rubelko, Gravenwezel (BE)

( * ) Notice: Subject to any disclaimer, the term of this patent is extended or adjusted under 35 U.S.C. 154(b) by 1178 days.

(21) Appl. No.: 12/440,257

(22) PCT Filed: Sep. 6, 2007

(86) PCT No.: PCT/EP2007/059354
§ 371 (c)(1),
(2), (4) Date: Dec. 3, 2009

(87) PCT Pub. No.: WO2008/028945
PCT Pub. Date: Mar. 13, 2008

(65) Prior Publication Data

US 2010/0077668 A1 Apr. 1, 2010

(30) Foreign Application Priority Data

Sep. 6, 2006 (BE) ..... 2006/0452

(51) Int. Cl.
*E06B 1/04* (2006.01)
*E05D 15/06* (2006.01)
(Continued)

(52) U.S. Cl.
CPC ..... *E05D 15/0652* (2013.01); *Y10T 16/3822* (2015.01); *E05D 13/04* (2013.01);
(Continued)

(58) Field of Classification Search
USPC ..... 49/404, 409, 410, 411, 425, 449, 504; 16/87 R, 94 R, 95 D, 95 R, 95 W, 95 DW, 16/96 R, 96 D, 96 L, 87.4 R, 87.6 W, 87.4 W
See application file for complete search history.

(56) References Cited

U.S. PATENT DOCUMENTS 4,612,743 A * 9/1986 Salzer ..... 52/208
6,446,394 B1 * 9/2002 Finke et al. ..... 49/409
(Continued)

FOREIGN PATENT DOCUMENTS

DE 9011081 10/1990
DE 19612125 11/1996
(Continued)

*Primary Examiner* — Katherine Mitchell
*Assistant Examiner* — Catherine A Kelly
(74) *Attorney, Agent, or Firm* — Jerold I. Schneider; Schneider Rothman; Intellectual Property Law Group PLLC

(57) ABSTRACT

A modular rail system for suspending sliding doors, including at least one rail profile having a top side arranged for being fixed against a horizontal wall part, a bottom side having a rail portion for carrying suspension wheels of a sliding door, a first lateral side arranged for being fixed against a vertical wall part, and an open second lateral side. On both opposite lateral sides the rail profile includes recesses having substantially the same shape for engaging complementary spacer elements. A sliding door system including a rail system, at least one sliding door with suspension wheels and at least one repositionable braking/stopping element having a stop for defining an extreme position of the sliding door and a releasable fixing element for fixing the braking/stopping element in the rail system. The fixing element is spaced a predetermined distance from the stop, chosen for maintaining user accessibility to the fixing element while the stop is located in a user inaccessible position.

18 Claims, 18 Drawing Sheets

(51) Int. Cl.

| | |
|---|---|
| ***E05C 17/60*** | (2006.01) |
| ***E05D 15/08*** | (2006.01) |
| ***E05F 5/00*** | (2006.01) |

(52) U.S. Cl.

CPC ..... *E05D15/0621* (2013.01); *E05D 15/0626* (2013.01); *E05D 15/08* (2013.01); *E05F 5/003* (2013.01); *E05Y 2201/11* (2013.01); *E05Y 2201/21* (2013.01); *E05Y 2201/48* (2013.01); *E05Y 2201/684* (2013.01); *E05Y 2600/00* (2013.01); *E05Y 2800/205* (2013.01); *E05Y 2800/21* (2013.01); *E05Y 2800/46* (2013.01); *E05Y 2800/682* (2013.01); *E05Y 2900/132* (2013.01); *E05Y 2800/242* (2013.01); *E05Y 2201/224* (2013.01); *E05Y 2600/60* (2013.01); *E05Y 2800/27* (2013.01); *E05Y 2800/29* (2013.01)

(56) References Cited

U.S. PATENT DOCUMENTS

| | | | | |
|---|---|---|---|---|
| 6,490,832 | B1 | 12/2002 | Fischbach et al. | |
| 6,557,303 | B2 * | 5/2003 | Finke et al. | 49/409 |
| 6,647,590 | B2 * | 11/2003 | Haab et al. | 16/90 |
| 6,668,500 | B1 * | 12/2003 | Lamberts | 52/204.72 |
| 7,712,258 | B2 * | 5/2010 | Ewing et al. | 49/410 |
| 7,770,259 | B2 * | 8/2010 | Janson et al. | 16/87 R |
| 2003/0172592 | A1 | 9/2003 | Krimmel | |
| 2006/0288529 | A1 * | 12/2006 | Chen et al. | 16/96 R |

FOREIGN PATENT DOCUMENTS

| | | |
|---|---|---|
| EP | 0385045 | 9/1990 |
| FR | 2651529 | 3/1991 |

* cited by examiner

MODULAR RAIL SYSTEM FOR SUSPENDING SLIDING DOORS AND SLIDING DOOR SYSTEM WITH USER ACCESSIBLE BRAKING/STOPPING ELEMENT

CROSS REFERENCE TO RELATED APPLICATIONS

This application is the entry into the United States of PCT Application No. PCT/EP2007059354 filed Sep. 6, 2007 and claims priority from Belgian Application No. 20060452 filed Sep. 6, 2006, the entirety of each of which are hereby incorporated by reference.

BACKGROUND OF THE INVENTION

1. Technical Field

The present invention relates to a modular rail system for suspending sliding doors according to the preamble of the first independent claim. The invention further relates to a sliding door system with a repositionable braking/stopping element.

2. Background Art

Sliding doors are nowadays frequently applied in private homes. The installation of the sliding door is not always simple and straightforward. Depending on the circumstances, the rail system needs to be fixed to a horizontal wall portion, a vertical wall portion or a ceiling, or at a distance from either. Often, there are obstructions in the vicinity which one has to take into account, such as light switches, electric wall sockets, floor plinths and the like, since the sliding door has to be able to safely pass these obstructions. Furthermore, in the case multiple sliding doors are to be installed which slide alongside each other, one has to adapt the distance between the adjacent rails to the thickness of the door, taking into account door handles or other protruding elements on the door panel.

Another problem with conventional sliding doors is that they are often installed such, that they "disappear" into a narrow gap, for example between two wall parts, between a wall and a closet, etc. This renders the mechanisms which are added onto the rail system for slowing down movement of the door or determining its extreme position inaccessible for later adjustments or repairs.

SUMMARY OF THE INVENTION

It is a first aim of the present invention to provide a modular rail system for suspending sliding doors which is easily adaptable to the circumstances.

It is a second aim of the present invention to provide a sliding door system in which access to braking/stopping elements for later adjustments or repairs is facilitated.

These and other aims of the invention are achieved with the modular rail system and the sliding door system of the independent claims.

As used herein, with "sliding door" is meant any type of door, wall panel, window or the like which is provided for being opened by a sideways movement.

As used herein, with "height direction" is meant the direction which is normally vertical in use.

As used herein, with "length direction" is meant the direction which is normally horizontal in use and corresponds to the longest horizontal dimension of the sliding door. This is also the direction in which the sliding door is moveable.

As used herein, with "cross direction" is meant the direction which is normally horizontal in use and corresponds to the shortest horizontal dimension of the sliding door. This is also the direction perpendicular to the direction in which the sliding door is moveable.

In a first aspect, the invention provides a modular rail system for suspending sliding doors, comprising at least one rail profile comprising:

- a top side having a first flat portion arranged for being fixed against a horizontal wall part,
- a bottom side having a rail portion for carrying suspension wheels of a sliding door,
- a first lateral side connecting the top side to the bottom side and having a second flat portion arranged for being fixed against a vertical wall part, and
- an open second lateral side opposite the first lateral side.

The rail system according to the invention is characterised in that on both opposite lateral sides the rail profile comprises recesses for engaging complementary spacer elements. The rail system further comprises at least one complementary spacer element, complementary to the recesses, for defining the distance between the rail profile and a horizontal wall part or another rail profile. The recesses have substantially the same shape, so that each spacer element can be inserted in any of the recesses.

This combination of rail profiles and spacer elements according to the invention can highly facilitate the installation of the rail system. The installer can simply select the spacer element with the appropriate dimensions, taking into account the obstructions which are encountered, and insert it into the appropriate recess for adapting the rail system to the specific circumstances. For example, if obstructions need to be overcome on the side of the vertical wall, to which the rail is to be mounted, the installer can simply add spacer element(s) by insertion in the recess(es) on the first lateral side. If a given distance needs to be provided between two adjacent rails, the installer can simply add an appropriate spacer element in between them. Since the recesses on the rail profiles are the same, the same spacer elements can be used on both sides.

Furthermore, since the rail profile has the first flat portion on the top side and the second flat portion on the first lateral side, it can be fixed to a horizontal wall portion or a ceiling, or to a vertical wall portion, or both. This can also be a simple operation, for example by applying screws in pre-drilled holes in the flat portions, or in another way known to the person skilled in the art.

The open second lateral side of the profile has the advantage that once the rail profile is installed, the sliding door can be placed by passing its suspension wheels through the opening on the second lateral side. This is easier than in the case of rail systems with closed lateral sides, where the suspension wheels can only be brought in place via the openings at the extremities of the rails. The open second lateral side further has the advantage that the interior of the rail is easily accessible to the installer, for example for operating fixing screws or adding other elements, such as for example a braking/stopping element or other.

In preferred embodiments, the spacer elements are simply oblong slats, for example aluminium slats, the thickness of which corresponds to the height of the recesses. Preferably, a plurality of these slats with stepwise varying widths are provided, so the installer can simply select the slat according to the space which needs to be created.

In preferred embodiments, one side of each recess in the rail profile is formed by a wing which is shaped for exerting a clamping force on the inserted spacer element. This means that the wing is slightly resilient, for example as a result of a reduced wall thickness at its base where it is connected to the rest of the profile, so that it can slightly bend away upon insertion of one of the spacer elements and that after insertion the wing holds the spacer element clamped firmly in position. This construction has the advantage that no additional means are required for holding the spacer elements in the recesses.

Preferably each rail profile comprises a first recess at a first corner formed by the top side and the first lateral side, a second recess at a second corner formed by the top side and the second lateral side, and a third recess at a third corner formed by the first lateral side and the bottom side. So in case the spacer elements are oblong slats, this means that two of these are insertable on the first lateral side, namely one at the top and one at the bottom, and one on the second lateral side. The third recess at the bottom has the advantage that by insertion of a spacer slat in this recess, the space behind the rail profile is closed off and the whole construction is easily given a finished look.

In preferred embodiments, the rail profile is provided with grooves for slidably holding a repositionable braking/stopping element, which defining an extreme position of the sliding door. This braking/stopping element can be easily added after the rail is installed via the open second lateral side.

In a second aspect, which may or may not be combined with the first aspect, the invention provides a sliding door system comprising:

a rail system, at least one sliding door with suspension wheels for suspending the sliding door in the rail system, and at least one repositionable braking/stopping element comprising a stop for defining an extreme position of the sliding door and a releasable fixing element for fixing the braking/stopping element in the rail system.

The sliding door system of the invention is characterised in that the fixing element of the braking/stopping element is spaced a predetermined distance from the stop. This distance is determined to be long enough for maintaining user accessibility to the fixing element while the stop may be located in a user inaccessible position. In other words, the distance is chosen such that when the braking/stopping element is placed in the rail system, possibly with the stop located between two adjacent walls between which the sliding door disappears, the fixing element by means of which the braking/stopping element is fixed to the rail system is still accessible, i.e. it is located at least close to the front opening of the gap between the two walls and preferably in the actual door opening, which is in front of this gap. In this way, the braking/stopping element is later on easily accessible for adjustments or repairs.

Preferably, the braking/stopping element further comprises a brake for slowing down movement of the sliding door before it hits the stop. This can avoid undesirable damage or wear to the stop or the door and can increase the life of the system.

In a first embodiment the braking/stopping element comprises a bent metal wire which is shaped for being slidably mounted in corresponding grooves in the rail system, the bent metal wire having a first part forming the stop, a second part forming the brake and a third part holding the releasable fixing element. This is a simply and thus cheap construction for the braking/stopping element.

In a second, alternative embodiment, the braking/stopping element comprises a central part holding the stop and the fixing element and comprising brakes in the form of leaf springs on opposite sides. In this embodiment, the braking/stopping element works in both directions for defining the extreme positions of the sliding door and slowing it down before reaching these. In this embodiment, the stop is preferably adjustably mounted on the central part for fine-tuning the extreme positions of the sliding door.

In preferred embodiments of the sliding door system, the suspension wheels are formed by inline wheels on a suspension block to which the sliding door is fixed. This suspension block is provided with positioning means for fine-tuning the position of the inline wheels with respect to the sliding door, such that all inline wheels remain in contact with the rail system. This embodiment has the advantage that the sliding door is carried by multiple inline wheels, which highly enhances the mobility of the sliding door and reduces the force which needs to be applied for opening/closing the door.

The positioning means preferably enable position adjustments both in height and length direction of the sliding door. In this way, the position of the sliding door in the door opening and also its extreme positions on the rail system can be fine-tuned after installation.

The positioning means preferably further comprise a compression spring extending in length direction of the sliding door between a first member on which the inline wheels are mounted and a second member to which the sliding door is fixed. This compression spring functions as a positioning aid which counteracts the tendency of the suspension block to tilt downwards as a result of the weight of the sliding door as long as the positioning means are loosened during the installation stage. So this compression spring can help to make sure that all the inline wheels will in the end be in contact with the rail system and suspend the sliding door.

In a preferred embodiment, at least one of the inline wheels comprises a protrusion for contacting the brake and/or the stop of the braking/stopping element. This is preferably the front wheel, i.e. the wheel closest to the edge of the sliding door, but one of the other wheels is also possible. The wheels may also be interchangeable to enable a coarse adjustment of the respective extreme position of the door.

In an alternative embodiment, the suspension block comprises a plurality of selectively extendable/retractable protrusions, spaced apart from each other in length direction of the sliding door, for contacting the stop of the braking/stopping element. This embodiment also enables a coarse adjustment of the extreme position of the door by selecting which of the protrusions is extended.

In preferred embodiments of the sliding door system according to the invention, the suspension block further comprises a tilt prevention means for preventing tilting of the sliding door upon being pushed by a user. This tilt prevention means preferably comprises a removable screw having a wide head portion which protrudes upwardly and is located in close proximity of the bottom side of the rail system.

In preferred embodiments of the sliding door system according to the invention, the suspension block is constructed such that in cross direction of the sliding door the inline wheels are located substantially in the middle of the sliding door, i.e. substantially within the plane of the centre of gravity of the sliding door.

In preferred embodiments of the sliding door system according to the invention, the sliding door comprises a wobble prevention means at the bottom for preventing wobbling of the sliding door. The wobble prevention means comprises a resiliently mounted running wheel, which runs on a guide rail at the bottom of the door or simply on the floor.

BRIEF DESCRIPTION OF THE DRAWINGS

The invention will be further elucidated by means of the following description and the appended figures.

FIGS. 27 and 28 respectively show a perspective view and an exploded view of an embodiment of a suspension block used in a sliding door system according to the invention.

DETAILED DESCRIPTION

Figure 1:
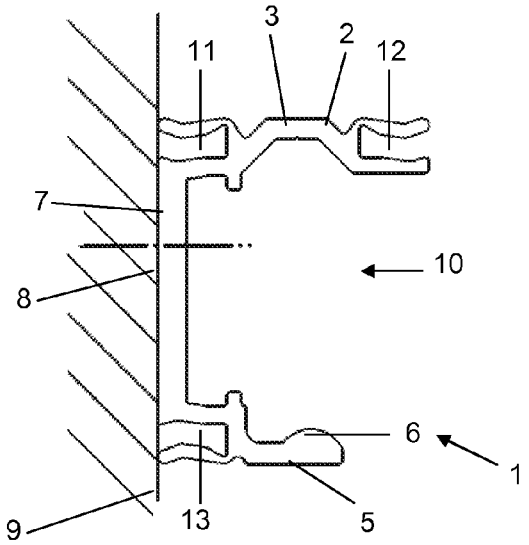
FIGS. 1-7 shows a cross-sections of a first embodiment of a modular rail system according to the invention.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not necessarily correspond to actual reductions to practice of the invention.

Furthermore, the terms first, second, third and the like in the description and in the claims, are used for distinguishing between similar elements and not necessarily for describing a sequential or chronological order. The terms are interchangeable under appropriate circumstances and the embodiments of the invention can operate in other sequences than described or illustrated herein.

Moreover, the terms top, bottom, over, under and the like in the description and the claims are used for descriptive purposes and not necessarily for describing relative positions. The terms so used are interchangeable under appropriate circumstances and the embodiments of the invention described herein can operate in other orientations than described or illustrated herein.

The term "comprising", used in the claims, should not be interpreted as being restricted to the means listed thereafter; it does not exclude other elements or steps. It needs to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Figure 2:
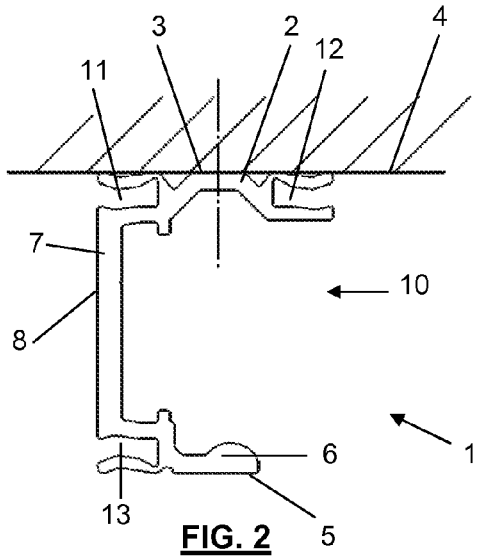
Figure 3:
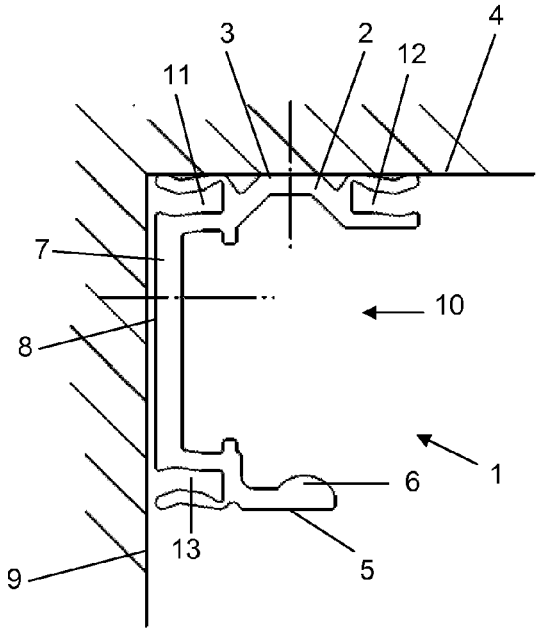

FIGS. 1-7 show a preferred embodiment of a modular rail system for suspending sliding doors according to the invention. The rail system comprises a rail profile 1 comprising a top side 2 having a first flat portion 3 arranged for being fixed against a horizontal wall part 4 (as shown in FIGS. 2 and 3), a bottom side 5 having a rail portion 6 for carrying suspension wheels of a sliding door, a first lateral side 7 connecting the top side 2 to the bottom side 5 and having a second flat portion 8 arranged for being fixed against a vertical wall part 9 (as shown in FIGS. 1 and 3), and an open second lateral side 10 opposite the first lateral side 7. On both opposite lateral sides 7, 10 the rail profile 1 comprises recesses 11, 12, 13 for engaging complementary spacer elements 14, 15 of the rail system, complementary to the recesses and provided for defining the distance D1 between the rail profile 1 and a horizontal wall part 9, or the distance D2 up to another rail profile 16, 17. The recesses 11, 12, 13 have substantially the same shape, so that each spacer element 14, 15 can be inserted in any of the recesses.

Figure 4:
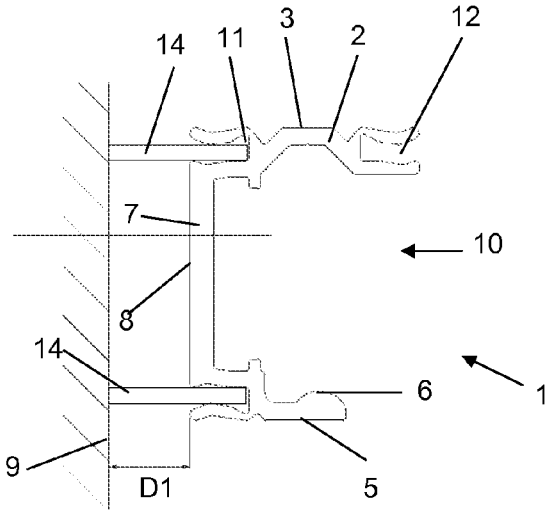
Figure 5:
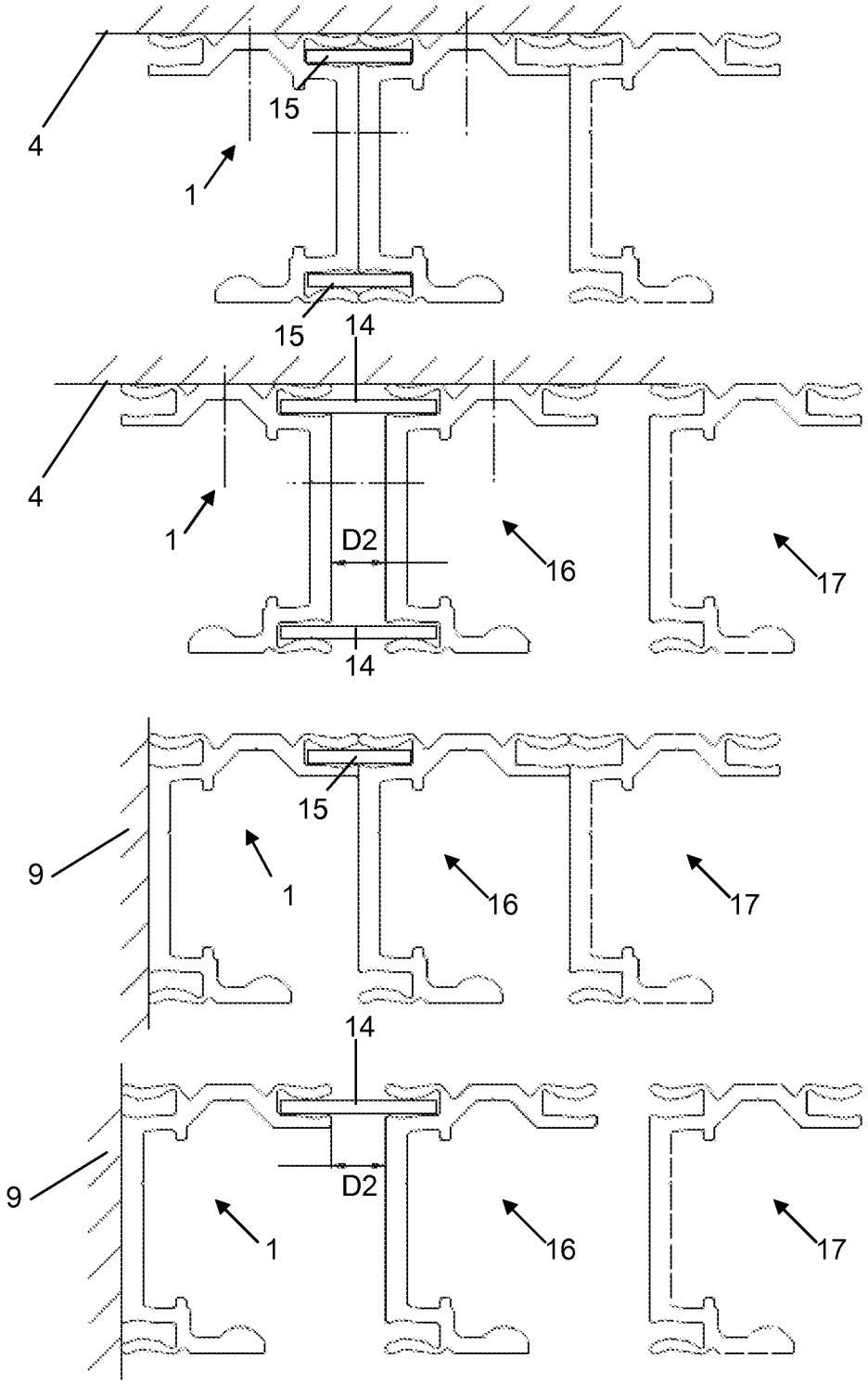

This combination of rail profiles 1, 16, 17 and spacer elements 14, can highly facilitate the installation of the rail system. The installer can simply select the spacer element 14, 15 with the appropriate dimensions, taking into account the obstructions which are encountered on the wall, on the sliding door etc., and insert it into the appropriate recess 11, 12, 13 for adapting the rail system to the specific circumstances. For example, if obstructions need to be overcome on the side of the vertical wall 9, to which the rail is to be mounted, the installer can simply add spacer elements 14, 15 by insertion in the recesses 11, 13 on the first lateral side 7, as shown in FIG. 4. If a given distance needs to be provided between two adjacent rails as shown in FIG. 5, the installer can simply add an appropriate spacer element 14, 15 in between them. Since the recesses 11-13 on the rail profiles are the same, the same spacer elements 14, 15 can be used on both sides. As shown in FIG. 5, the spacer elements 15 may also be dimensioned for mounting two rail profiles 1, 16, 17 against each other, so with substantially no distance between them. This can facilitate the fixing of the two rail profiles 1, 16 onto each other and forms an additional reinforcement.

In particular each rail profile comprises a first recess 11 at a first corner formed by the top side 2 and the first lateral side 7, a second recess 12 at a second corner formed by the top side 2 and the second lateral side 10, and a third recess 13 at a third corner formed by the first lateral side 7 and the bottom side 5.

In the embodiment of FIGS. 4 and 5, the spacer elements 14, 15 are oblong slats. Two of these are insertable on the first lateral side 7, namely one at the top and one at the bottom, and one on the second lateral side 10. The third recess 13 at the bottom has the advantage that by insertion of a spacer slat 14, 15 in this recess, the space behind the rail profile is closed off and the whole construction is easily given a finished look.

In particular, FIG. 5 shows multiple different configurations which can be achieved with the rail profiles 1, 16, 17 and two types of spacer elements 14, 15 of different width. The top row shows three rail profiles 1, 16, 17 fixed against a horizontal wall part 4 with substantially no distance in between them. The first two profiles 1, 16 are fixed back to back, with their first lateral sides 7 against each other. Their connection is reinforced by two spacer slats 15 in the recesses on this side. In the second row, the difference is that the rail profiles 1, 16, 17 are mounted at a given distance D2 from each other, determined in function of obstructions such as light switches, wall sockets, door handles etc. To this end, the wider spacer slats 14 are used. In the third and fourth rows, the rail profiles 1, 16, 17 are mounted in the same orientation, i.e. always open in the same direction, against a vertical wall part 9. In the third row, the distance between them is substantially zero, so the slats 15 functioning as reinforcement are used. In the fourth row, the distance in between is again D2, so the wider slats 14 are used.

The fixing of the rail profiles 1, 16, 17 to the walls 4, 9 is preferably a simple operation, for example by applying screws in pre-drilled holes in the flat portions, or in another way known to the person skilled in the art.

The open second lateral side 10 of the profile 1, 16, 17 has the advantage that once the rail profile is installed, the sliding door can be placed by passing its suspension wheels through the opening on the second lateral side. This is easier than in the case of rail systems with closed lateral sides, where the suspension wheels can only be brought in place via the openings at the extremities of the rails. The open second lateral side 10 further has the advantage that the interior of the rail is easily accessible to the installer, for example for operating fixing screws or adding other elements, such as for example a braking/stopping element or other.

In the embodiments shown, the spacer elements 14, 15 are simply oblong slats, for example aluminium slats, the thickness of which corresponds to the height of the recesses 11-13. Preferably, a plurality of these slats with stepwise varying widths are provided, so the installer can simply select the slat according to the space which needs to be created.

Figure 6:
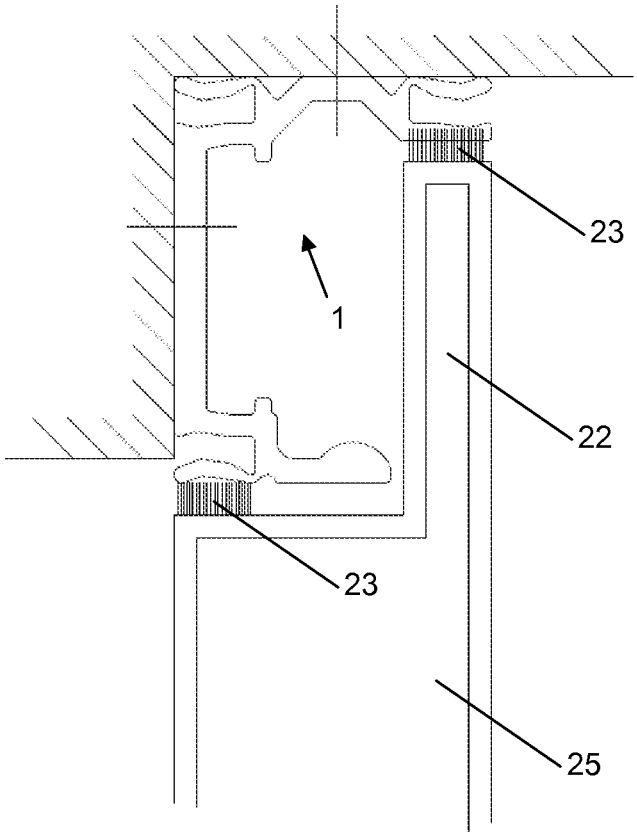
Figure 7:
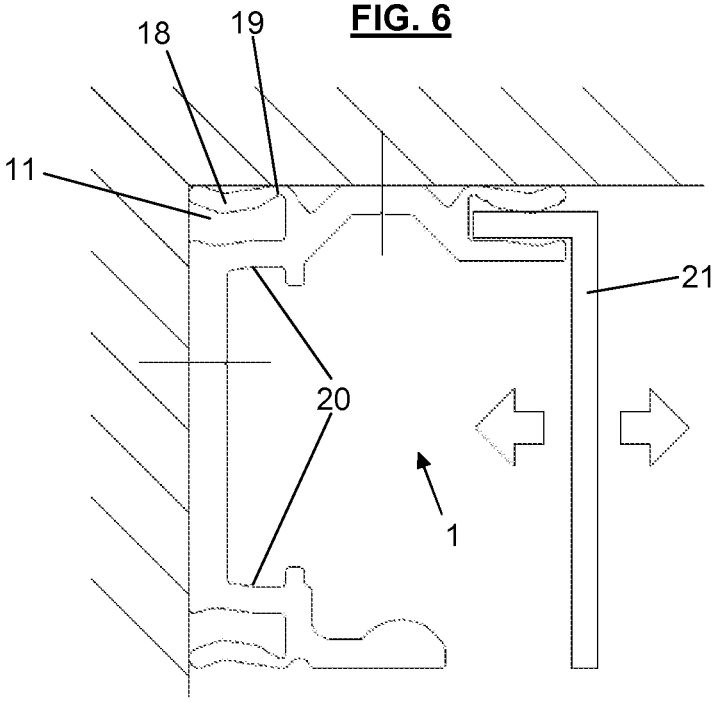

As shown in FIGS. 6 and 7, the open lateral side 10 of the rail profile 1 can in use be closed off by an upstanding top part 22 of the sliding door or a separate closing element 21, e.g. an L-profile, insertable in the recess 12 of the profile 1. Draft preventing brushes 23 or strips or the like may be provided on the top side of the sliding door to close off the gap between the door and the rail.

Some further details of the rail profile 1 are explained with reference to FIG. 7. In the embodiments shown, one side of each recess 11-13 in the rail profile 1 is formed by a wing 18 which is shaped for exerting a clamping force on the inserted spacer element 14, 15. This is achieved by means of a reduced wall thickness at its base 19 where it is connected to the rest of the profile, so that it can slightly bend away upon insertion of one of the spacer elements 14, 15 and that after insertion the wing 18 holds the spacer element clamped firmly in position. This construction has the advantage that no additional means are required for holding the spacer elements 14, 15 in the recesses. The reduced wall thickness at the base 19 further forms a space at the base of the recess 11 where an excess adhesive can be collected, in case an adhesive is applied for enhancing the connection between the rail profile 1 and the spacer elements 14, 15.

The rail profile 1 is further provided with grooves 20 for slidably holding a repositionable braking/stopping element, examples of which will be described further on. Such a braking/stopping element can be easily added after the rail is installed via the open second lateral side 10.

A first embodiment of a sliding door system using the above described rail profile 1 will now be described with reference to FIGS. 8-20. The sliding door system comprises at least one rail profile 1, at least one sliding door 25 with suspension wheels 26 for suspending the sliding door in the rail system, and at least one repositionable braking/stopping element 27. The latter comprises a stop element 28 for defining one or both extreme positions of the sliding door 25, i.e. for determining up to where the door can slide, and two releasable fixing elements 31 for fixing the braking/stopping element 27 in the rail system 1. These fixing elements are spaced a predetermined, somewhat variable distance from the stop element 28. This distance is somewhat variable in that the position of the stop element 28 can be adjusted to a small extent for fine tuning the extreme position(s) of the sliding door 25. Minimally, the distance is selected to be long enough for maintaining user accessibility to at least one of the fixing elements 31 while the stop element 28 may be located in a user inaccessible position, for example between two adjacent walls between which the sliding door 25 disappears.

Figure 8:
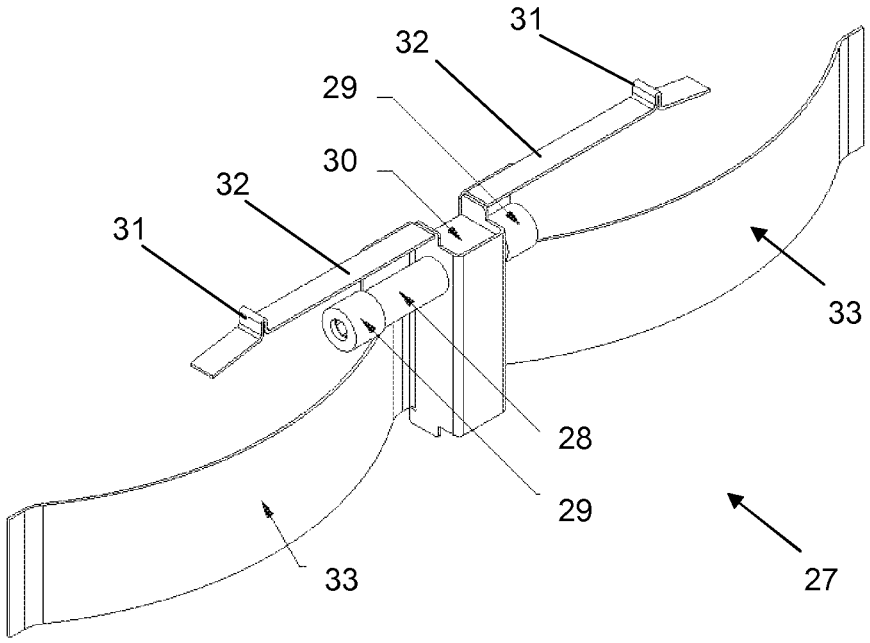
FIGS. 8, 9 and 10 respectively show a front perspective view, a rear perspective view and an exploded view of a first embodiment of a repositionable braking/stopping element of a sliding door system according to the invention.
Figure 9:
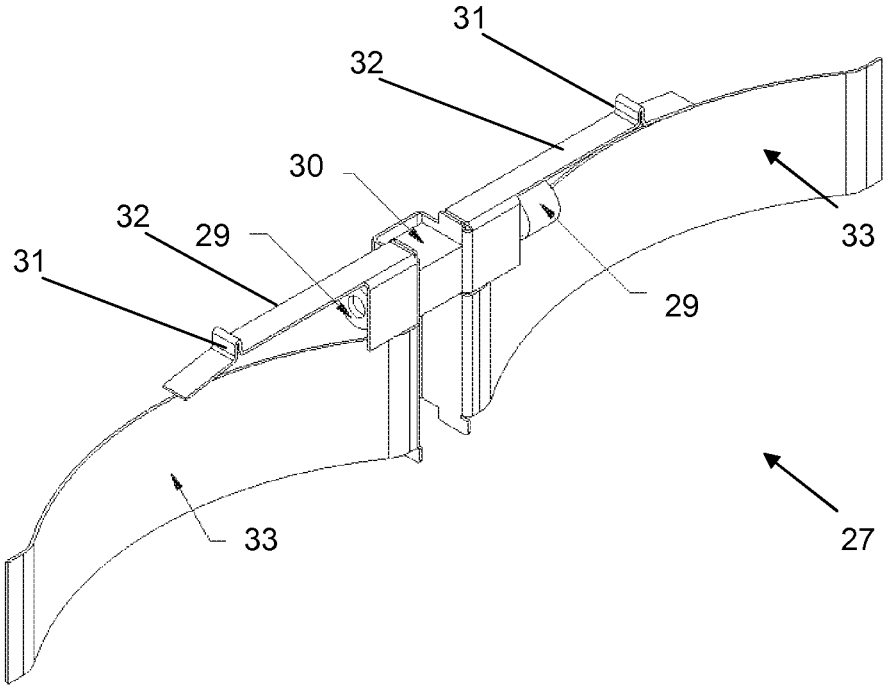
Figure 10:
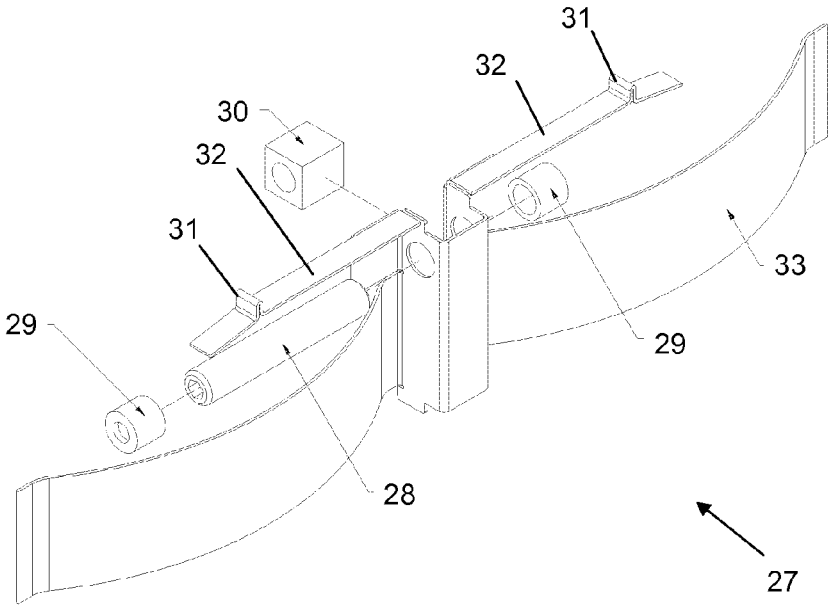

As shown in FIGS. 8-10, the fixing elements 31 are formed by protrusions on resilient arms 32. These protrusions 31 enter into holes 34 provided in the rail profile 1. In case the sliding door 25 disappears between two walls, only one of these protrusions 31 may be in a position which is directly accessible to the user. The fixing element 31 on the other side, may be not in an immediately user accessible position, but can be released after the first one has been released, by using a thin tool such as a knife, to push the protrusion 31 out of the hole in which it is located. In this way, the braking/stopping element 27 can be easily released from the rail profile 1 by the user for making adjustments or repairs to the braking/stopping element 27.

The braking/stopping element 27 further comprises brakes in the form of leaf springs 33 on both sides for slowing down movement of the sliding door 25 before it hits the stop element 28. This can avoid undesirable damage or wear to the stop element 28 or the door 25 and can increase the life of the system.

FIG. 10 shows in exploded view the constituent parts of the braking/stopping element 27. A central part 30 is provided with a through-bore for holding the stop 28. A bent and cut sheet metal element has parts forming the resilient arms 32 with the fixing elements 31 and the leaf springs 33 on opposite sides. The stop 28 is a tubular bolt which also function to fix the sheet metal element to the central part 30. Cap parts 29 are screwed over the ends of the bolt 28. By rotating the bolt 28 in the through-bore, the stop moves slightly towards the left or towards the right for fine-tuning its position.

Figure 11:
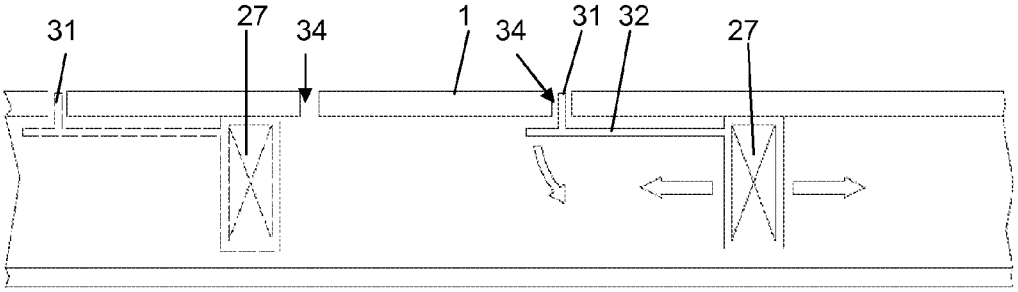
FIGS. 11 and 12 schematically show the operation of the braking/stopping element of FIGS. 8-10.

FIG. 11 schematically shows the way in which the braking/stopping element 27 is repositioned on the rail profile 1. Its position is fixed by the fixing elements 31 which enter into holes 34 in the rail 1. A plurality of holes 34 are provided so that the braking/stopping element can be mounted in a plurality of positions. By operating the resilient arm 32, as shown by the arrows, the position can be released. In this way, a coarse adjustment of the position of the braking/stopping element 27 can be made.

Figure 12:
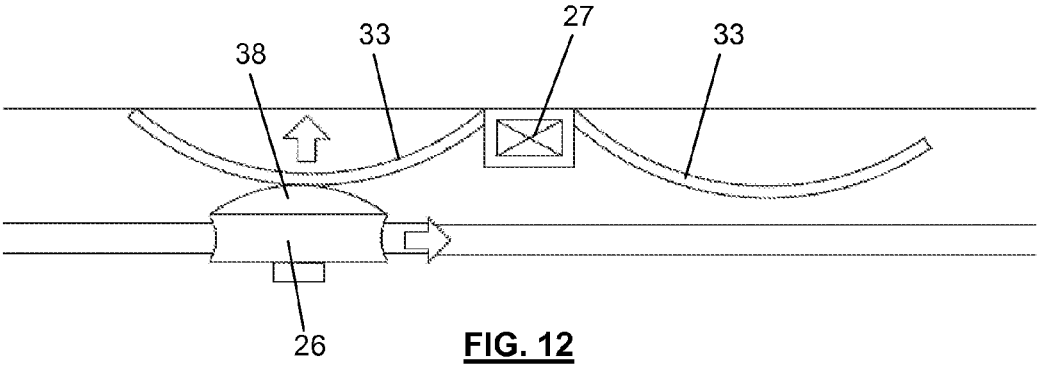

FIG. 12 schematically shows the operation of the brake 33 of the braking/stopping element 27. A convex front surface 38 of the suspension wheels 26 faces the brake 33, which has the form of a leaf spring. Upon approach, the surface 38 pushes the leaf spring 33 in the direction of the arrow onto the side wall of the rail 1, as a result of which the leaf spring 33 presses on the wheel 26 to slow down the movement of the door.

Figure 13:
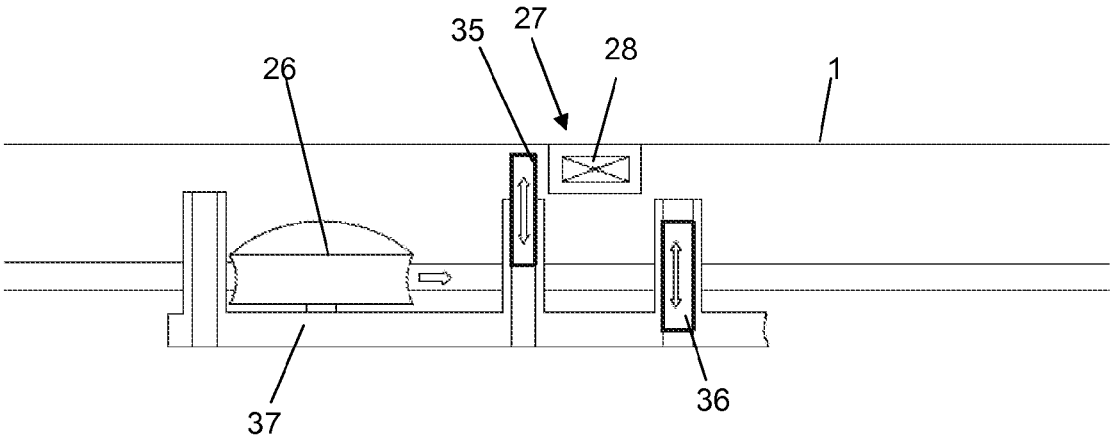
FIGS. 13 and 14 schematically show one type of means provided in a sliding door system according to the invention for adjusting the extreme position of the sliding door.
Figure 14:
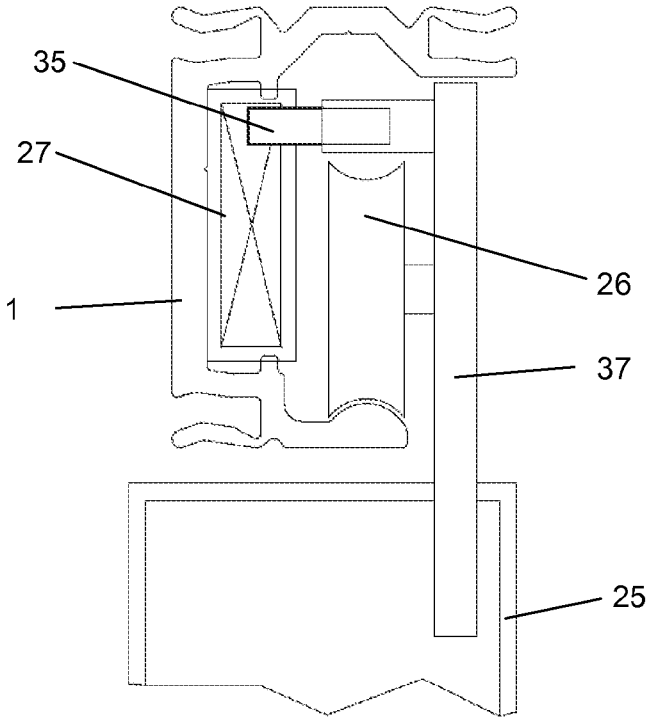

FIGS. 13 and 14 schematically show another way in which the extreme position(s) of the sliding door 25 can be adjusted. The suspension wheels 26 are mounted on a suspension block 37. This suspension block 37 comprises a plurality of selectively extendable/retractable protrusions 35, 36, spaced apart from each other in length direction of the sliding door 25, for contacting the stop 28 of the braking/stopping element 27. As shown one of these protrusions 35 is extended, whereas the others 36 are retracted. In this way, a coarse adjustment of the extreme position of the door can be made by selecting which of the protrusions 35, 36 is extended.

Figure 15:
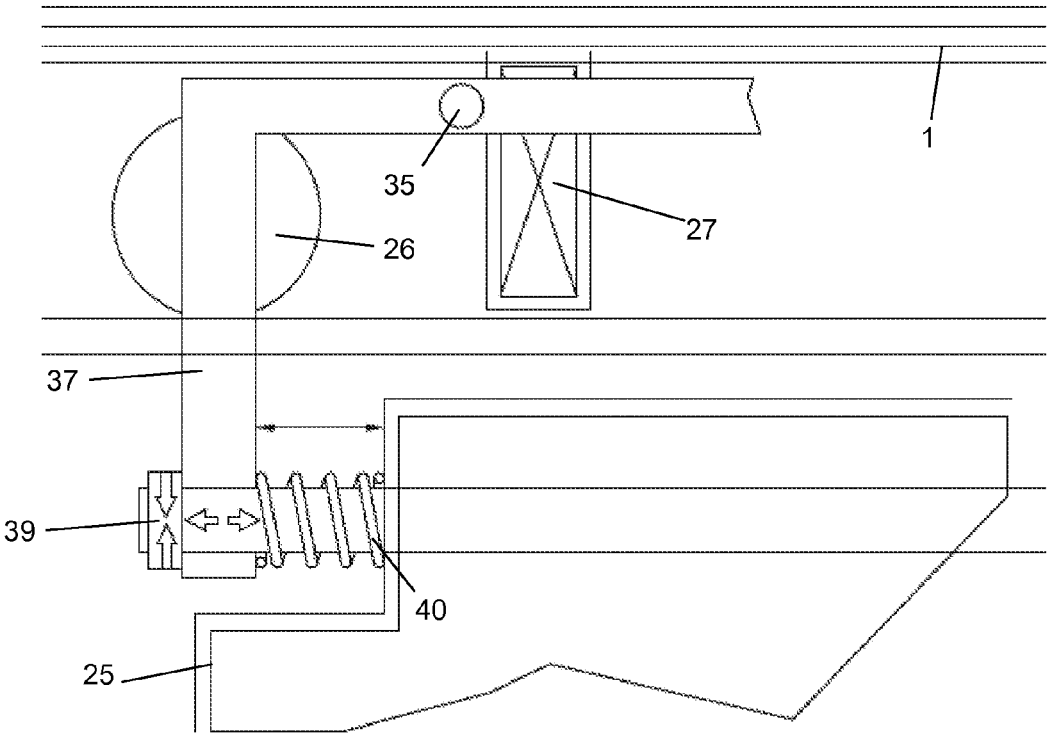
FIG. 15 schematically shows another type of means provided in a sliding door system according to the invention for adjusting the extreme position of the sliding door.

FIG. 15 shows a further fine-tuning system which is provided on the sliding door system for the extreme position of the sliding door 25, in particular the position of the sliding door 25 with respect to the suspension block 37 carrying the suspension wheels 26. The door 25 is connected to the suspension block 37 by means of a screw 39 which carries a spring 40. By rotating the screw 39, the suspension block 37 is moved towards or away from the sliding door 25.

So in all, there are multiple provisions in the sliding door system of FIGS. 8-20 for coarsely and finely adjusting the extreme positions of the sliding door 25. This has the advantage that the positioning of the sliding door 25 with respect to the door opening, which it is intended to close off, is greatly facilitated and that final adjustments can be easily made after the complete system has been installed.

Figure 16:
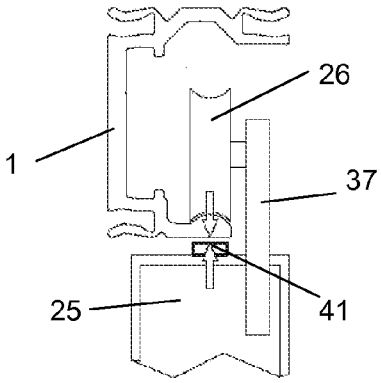
FIGS. 16-19 schematically show further features of a sliding door system according to the invention.
Figure 17:
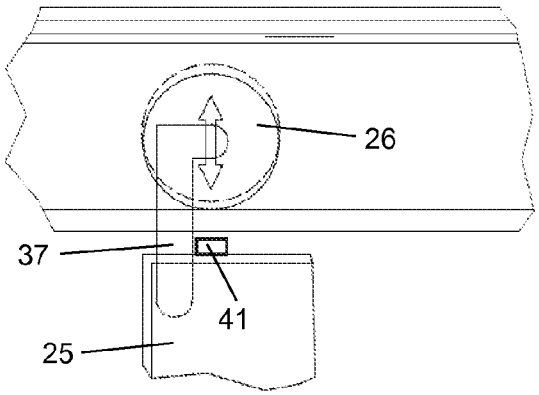

FIGS. 16 and 17 explain on the one hand that the sliding door 25 is placed on the rail profile 1 via its open side and on the other hand that a tilt prevention means 41 is provided for preventing tilting of the sliding door upon being pushed by a user. This tilt prevention means 41 is preferably removable, so that it can be put in place after the door 25 is hung on the rail 1 and removed in case the door 25 needs to be removed from the rail 1. The tilt prevention means 41 protrudes upwardly towards the bottom side of the rail profile 1.

Figure 18:
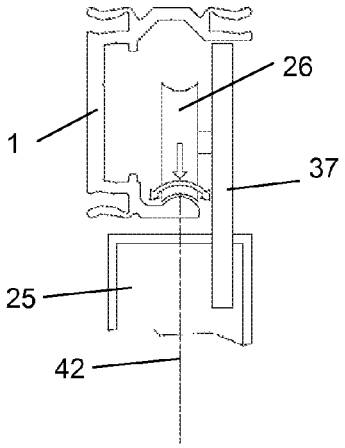

FIG. 18 shows that the suspension wheels 26 are preferably located substantially in the middle of the sliding door in cross direction, i.e. substantially within the plane 42 of the centre of gravity of the sliding door 25.

Figure 19:
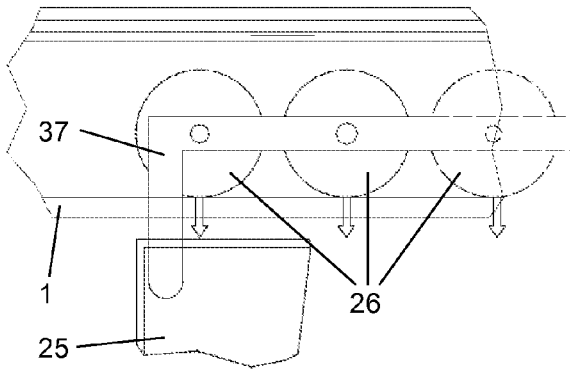

FIG. 19 shows that the suspension block 37 is preferably provided with a plurality of inline suspension wheels 26.

Figure 20:
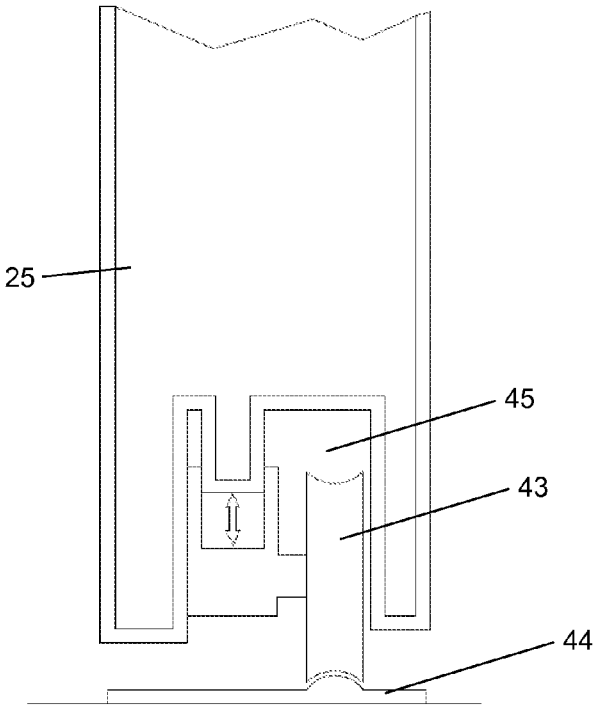
FIG. 20 shows an embodiment of a wobble prevention means of a sliding door system according to the invention.

FIG. 20 shows the bottom part of the sliding door 25. A resiliently mounted running wheel 43, which runs on a guide rail 44 on the floor, provides a means to prevent wobbling of the door, i.e. to enhance the stability of the door 25. The running wheel 43 can move upwards in a cavity 45 in the bottom side of the sliding door 25 against the action of a spring, so that variations in the gap between the bottom side of the door and the floor can be overcome.

A second embodiment of a sliding door system will now be described with reference to FIGS. 21-35. The sliding door system comprises at least one rail profile 51, at least one sliding door 75 with suspension wheels 76 for suspending the sliding door in the rail system, and at least one repositionable braking/stopping element 77.

Figure 24:
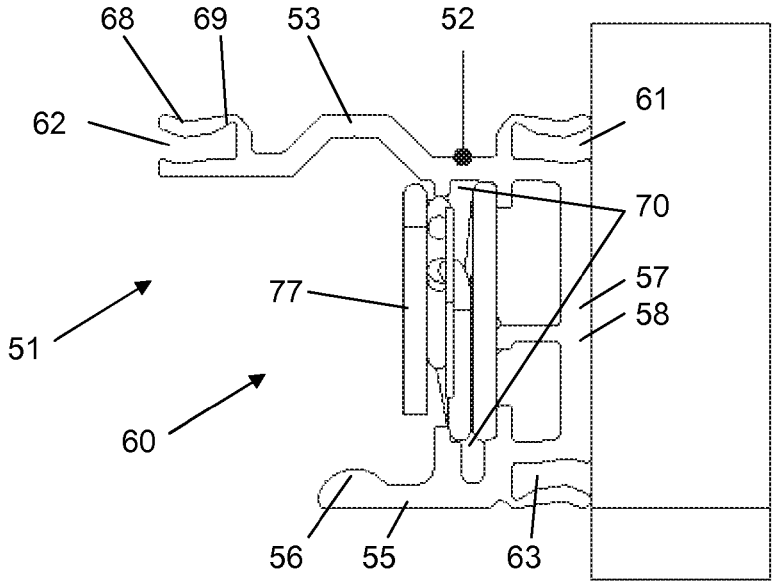
FIG. 24 shows a cross-section of an alternative embodiment of a rail profile according to the invention, with the braking/stopping element of FIG. 21.

The rail profile 51 is slightly different from that described above, but nonetheless shows the same features, see FIG. 24:

- a top side 52 having a first flat portion 53 arranged for being fixed against a horizontal wall part,
- a bottom side 55 having a rail portion 56 for carrying the suspension wheels 76 of the sliding door 75,
- a first lateral side 57 having a second flat portion 58 arranged for being fixed against a vertical wall part,
- an open second lateral side 60,
- first, second and third recesses 61, 62, 63 for engaging complementary spacer elements 14, 15, each recess having a wing 68 with a reduced wall thickness at its base 69 for exerting a clamping force on the inserted spacer element 14, 15,
- a space at the base 69 where an excess adhesive can be collected,
- grooves 70 for slidably holding the repositionable braking/stopping element 77.

As a result, the profile 51 functions in the same way as the profile 1 described above and will not be described in great detail here. The spacer slats 14, 15 are usable with both profiles 1, 51.

Figure 21:
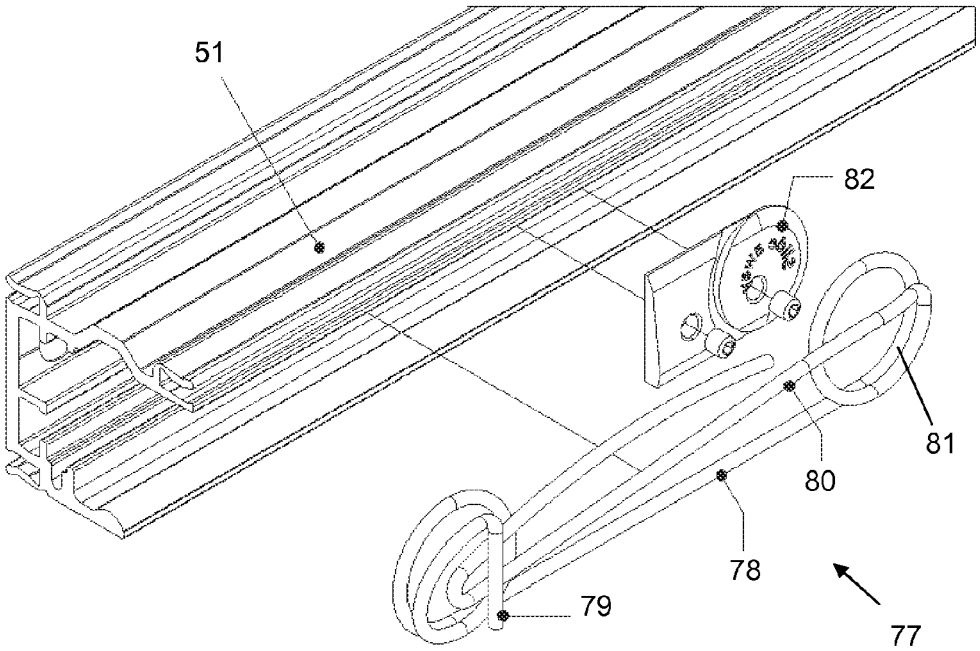
FIGS. 21-23 show an alternative embodiment of a repositionable braking/stopping element of a sliding door system according to the invention.

The repositionable braking/stopping element 77 of this embodiment of the sliding door system is shown in FIG. 21. It comprises a bent metal wire 78 which is shaped for being slidably mounted in the corresponding grooves 70 in the rail system, the bent metal wire having a first part 79 forming the stop, a second part 80 forming the brake and a third part 81 holding the releasable fixing element 82. This is a simple and thus cheap construction for the braking/stopping element 77.

The stop 79 defines an extreme position of the sliding door 75, i.e. for determining up to where the door can slide. The fixing element 82 comprises two screws which can be screwed against the rail profile 51 for fixing the position of the braking/stopping element 77. So in this embodiment, the position of the element 77 is adjustable in a continuous manner, whereas in the previous embodiment the position was stepwise adjustable. The fixing element 82 are spaced a predetermined distance from the stop part 79, the distance being selected to be long enough for maintaining user accessibility to the fixing elements 82 while the stop part 79 may be located in a user inaccessible position, for example between two adjacent walls between which the sliding door 75 disappears. This is clearly visible on FIGS. 25 and 26: the fixing element 82 is visible and accessible above the door opening rail 51 whereas the stop part 79 is hidden sideways from the door opening.

The brake 80 is a part of the wire 78 which is arranged for being resiliently compressed against the rail profile 51 by a protrusion 85 on one of the inline suspension wheels 76, in particular the foremost wheel 84. The stop 79 is a vertically extending wire part against which the protrusion 85 of this wheel runs. The operation of these parts will be described in detail below. Note that the brake 80 and the stop 79 are located besides the path of the other inline wheels 76 which do not carry the protrusion 85. As a result, passage of these wheels and also the inline wheels (not shown) at the opposite end of the sliding door can occur unhindered.

Figure 22:
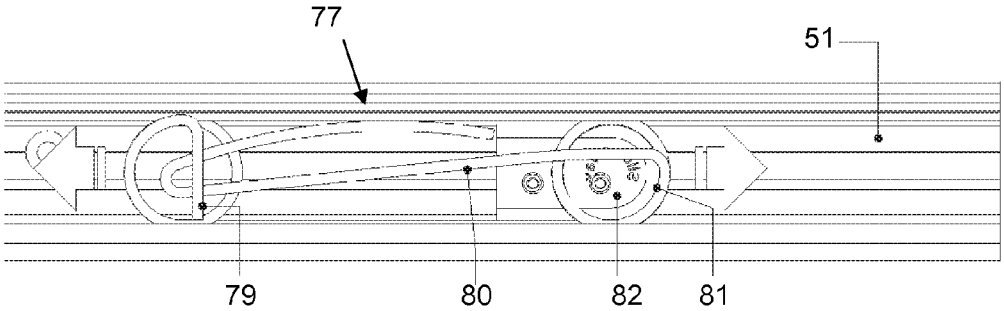
Figure 23:
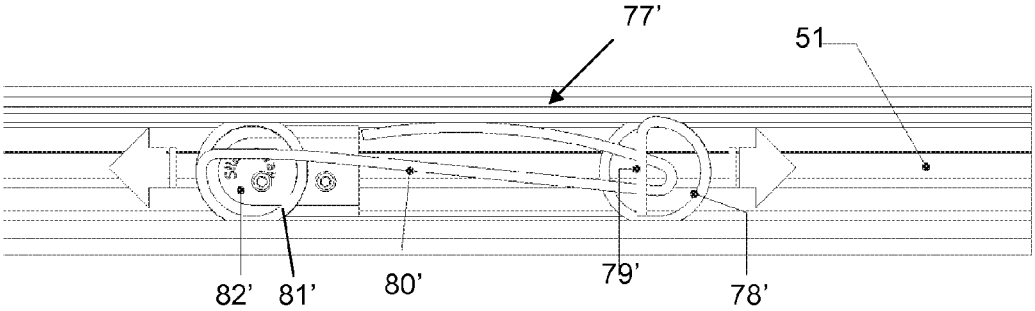

The protrusion 85 on the inline wheel 84 can be used in both directions. As shown in FIGS. 22 and 23, separate braking/stopping elements 77, 77' are applied for determining the two extreme positions of the sliding door 75, but both can act on the same protrusion 85 of the same inline wheel 84. It is also possible to provide two of the wheels of the sliding door with a protrusion 85, one for each extreme position, but this is not necessary.

The braking/stopping element 77 shown in FIG. 22 and also in FIG. 21 determines the leftmost position of the sliding door 75. The braking/stopping element 77' shown in FIG. 23 and also in FIGS. 25-28 determines the rightmost position of the sliding door 75. The braking/stopping element 77' of FIG. 23 is the mirror image of the one 77 of FIG. 22, so also comprises a bent metal wire 78', shaped for being slidably mounted in the corresponding grooves 70 in the rail system and having a first part 79' forming the stop, a second part 80' forming the brake and a third part 81' holding the releasable fixing element 82'. It is evident that the operation of both elements 77, 77', which will be described in detail below for the element 77' is exactly the same.

Figure 25:
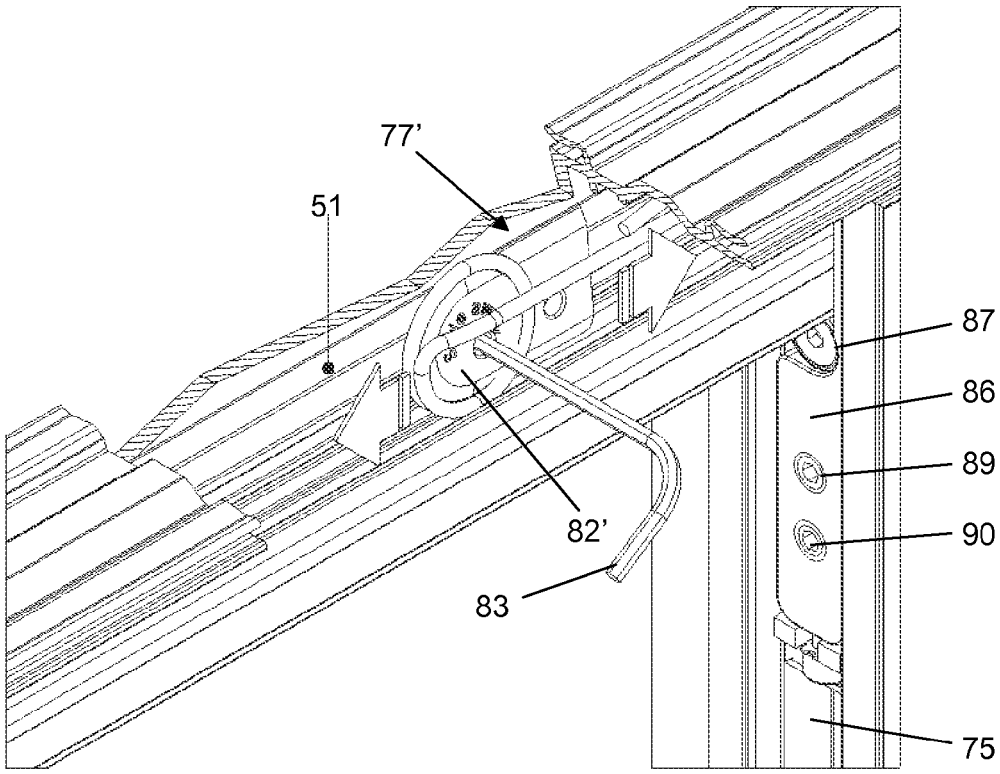
FIGS. 25-28 show the operation of the braking/stopping element of FIG. 23.
Figure 26:
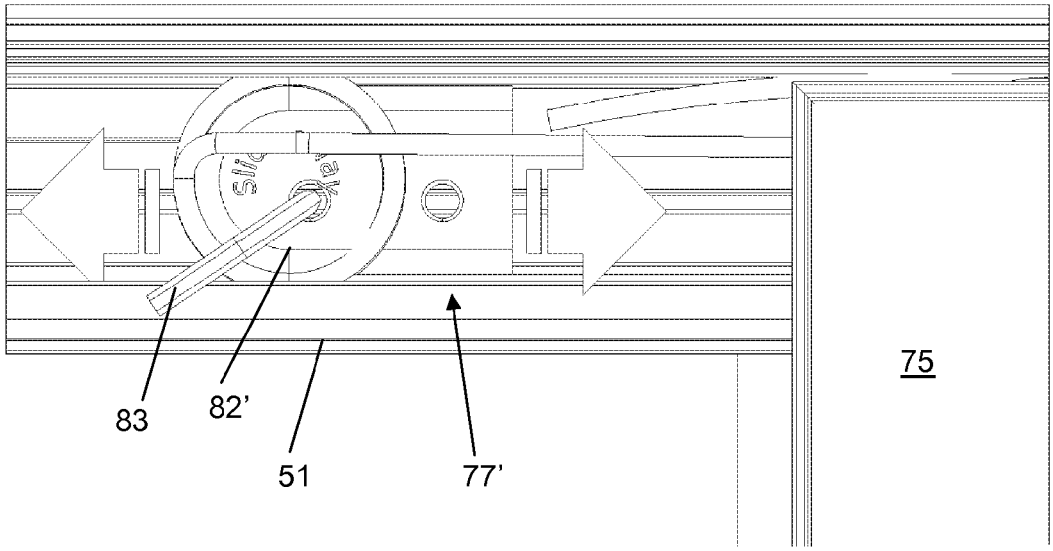

FIGS. 25 and 26 show how the position of the braking/stopping element 77' is adjusted. It is again stressed that the fixing element 82' is accessible after complete installation of the sliding door system to make final adjustments or repairs later on. The adjustment is performed as follows. By means of the suitable tool 83 the screws of the fixing element 82' are loosened. Then, the braking/stopping element 77' is slid to the left or to the right in the rail profile 51 until the desired position is reached. Finally, the screws of the fixing element 82' are again tightened by means of the tool 83. This shows that the adjustment is very simple.

Figure 27:
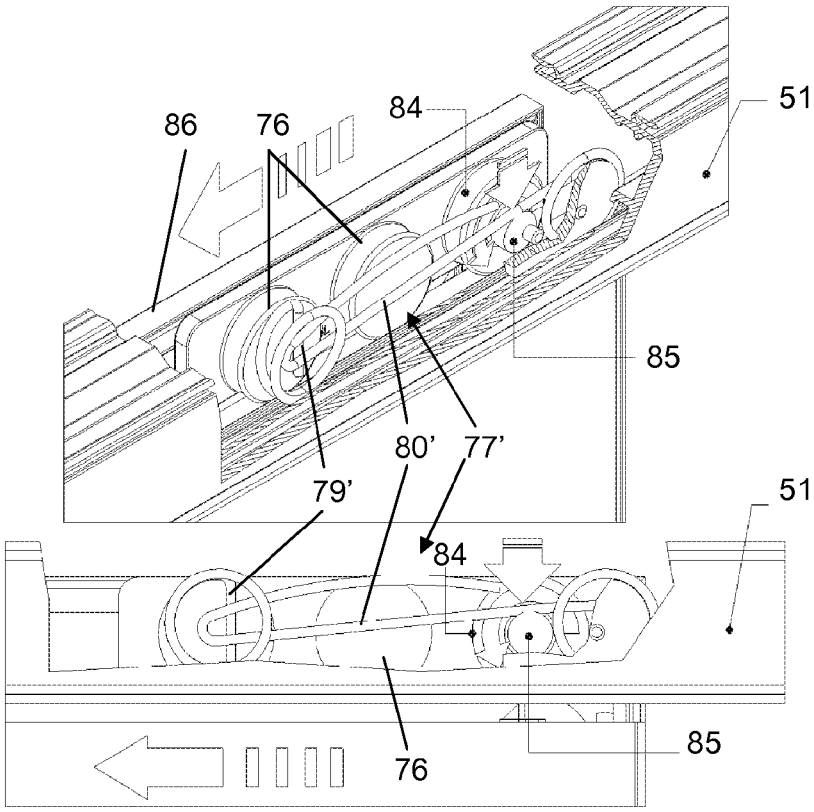
Figure 28:
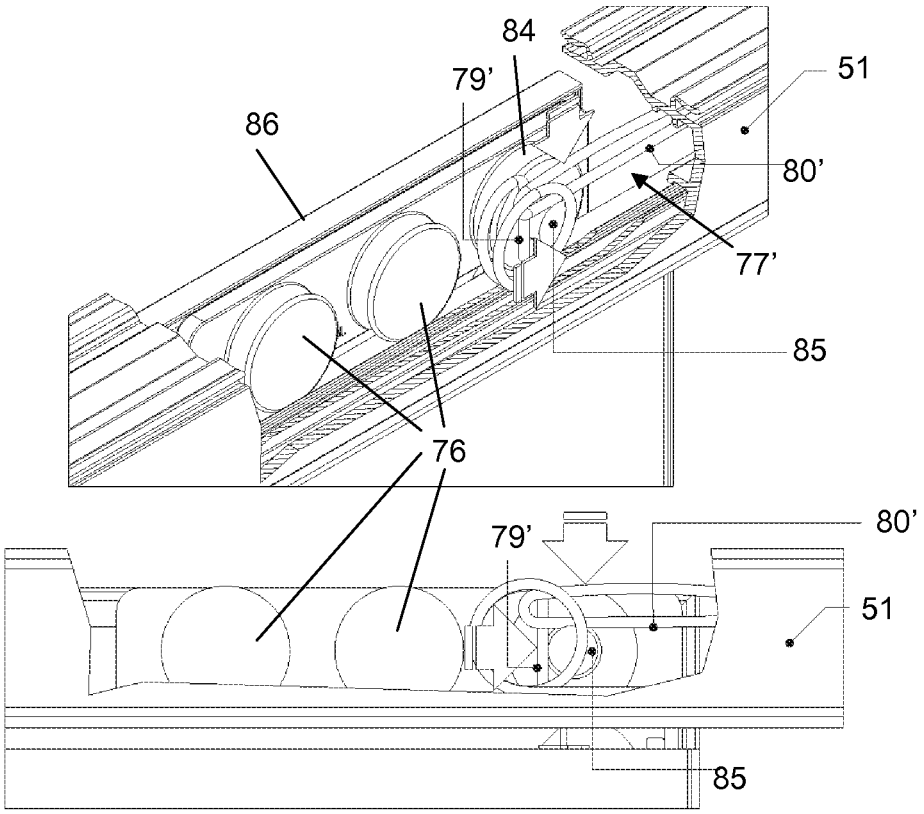

FIGS. 27 and 28 show the operation of the brake part 80' and the stop part 79' of the braking/stopping element 77'. In FIG. 27, the sliding door 75 approaches the rightmost position, i.e. the extreme position defined by the element 77', in the direction of the arrow. Before the extreme position is reached, the protrusion 85 on the suspension wheel 84 comes into contact with the brake part 80', compressing the latter against the top side of the rail profile 51 as it moves along. In view of the resiliency of the metal wire 78', the brake part 80' counteracts the compression and exerts pressure on the protrusion 85, thereby slowing down the movement of the sliding door 75. In FIG. 28, the sliding door 75 is shown in the extreme position with the protrusion 85 contacting the brake part 79'. These figures also show that the other suspension wheels 76 can pass unhindered.

The braking/stopping elements 77, 77' can be inserted into or removed from the grooves 70 of the rail profile 51 via the extremities of the profile, or via the open lateral side 60. In the latter case, a tool such as a pair of tongs is used for slightly reducing the size of the braking/stopping element 77, 77', which is possible as a result of the resiliency of the metal wire 78, 78', so that the element 77, 77' can snap into the grooves 70 of the profile 51.

Figure 29:
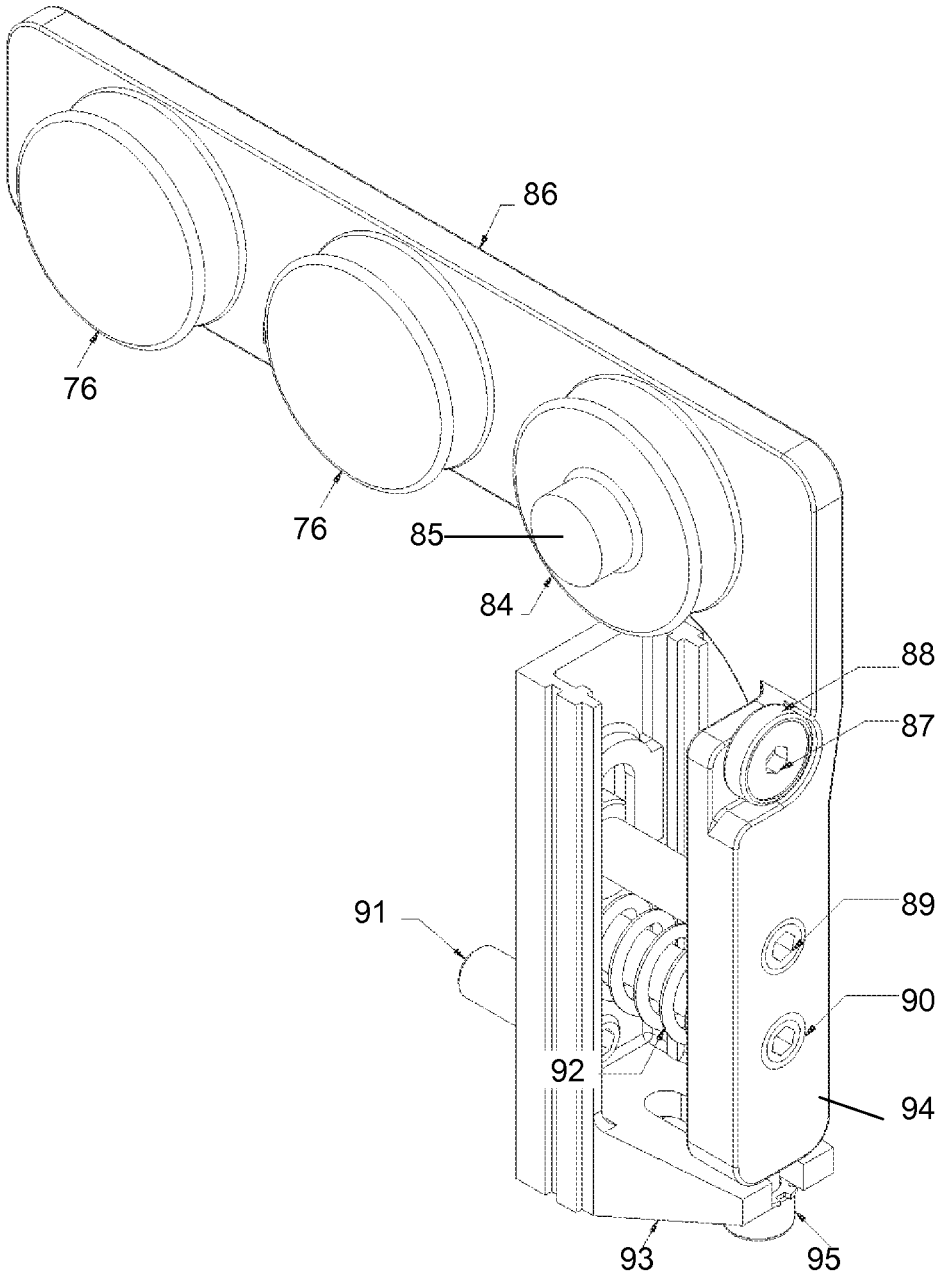
FIGS. 29 and 30 respectively show a perspective view and an exploded view of another embodiment of a suspension block used in a sliding door system according to the invention.
Figure 30:
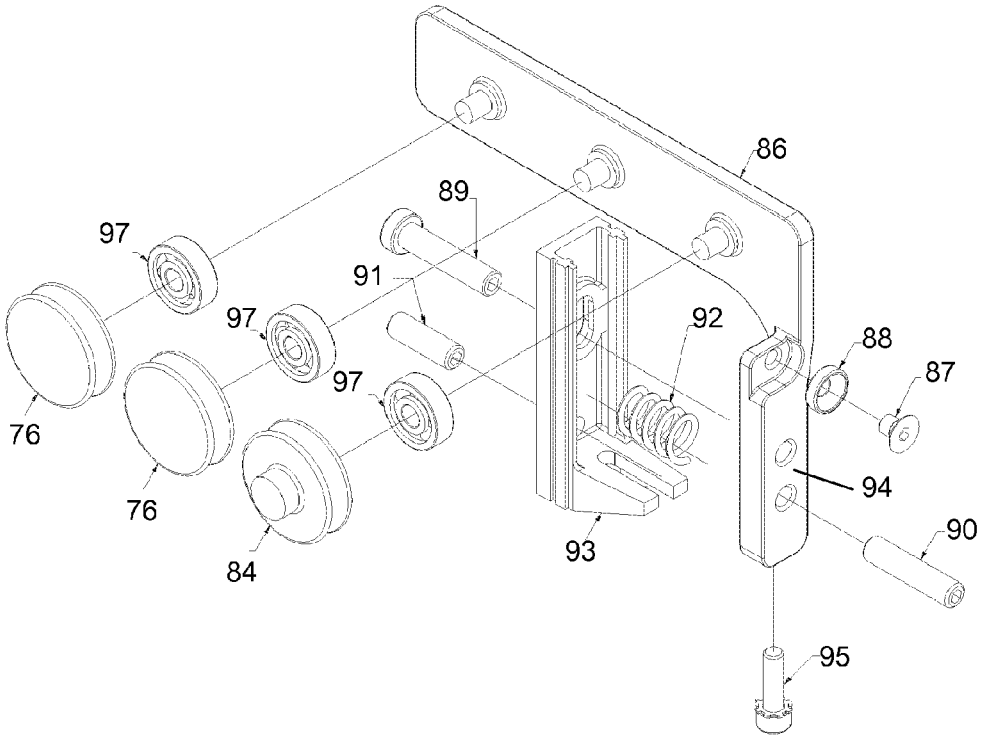

As shown in FIGS. 29 and 30, the suspension wheels are formed by inline wheels 76, 84, mounted by means of ball bearings 97 on a suspension block 86 to which the sliding door 75 is fixed Suspending the door by multiple inline wheels highly enhances the mobility of the sliding door and reduces the force which needs to be applied for opening/closing the door. The foremost 84 of the inline wheels 76 comprises a protrusion 85 for contacting the brake 80 and the stop 79 of the braking/stopping element 77. It is also possible to provide this protrusion on one of the other wheels 76. The wheels 76, 84 may also be interchangeable to enable a coarse adjustment of the respective extreme position of the door. The suspension block 86 is constructed such that in cross direction of the sliding door 75 the inline wheels 76, 84 are located substantially in the middle of the sliding door, i.e. substantially within the plane of the centre of gravity of the sliding door.

The suspension block 84 is provided with positioning means for fine-tuning the position of the inline wheels 76, 84 with respect to the sliding door 75. These positioning means have a dual function: on the one hand to ensure that all inline wheels 76, 84 remain in contact with the rail profile 51 and on the other hand to fine-tune the position of the sliding door 75 in the door opening and/or in the extreme positions. The positioning means enable position adjustments both in height and length direction of the sliding door.

Figure 33:
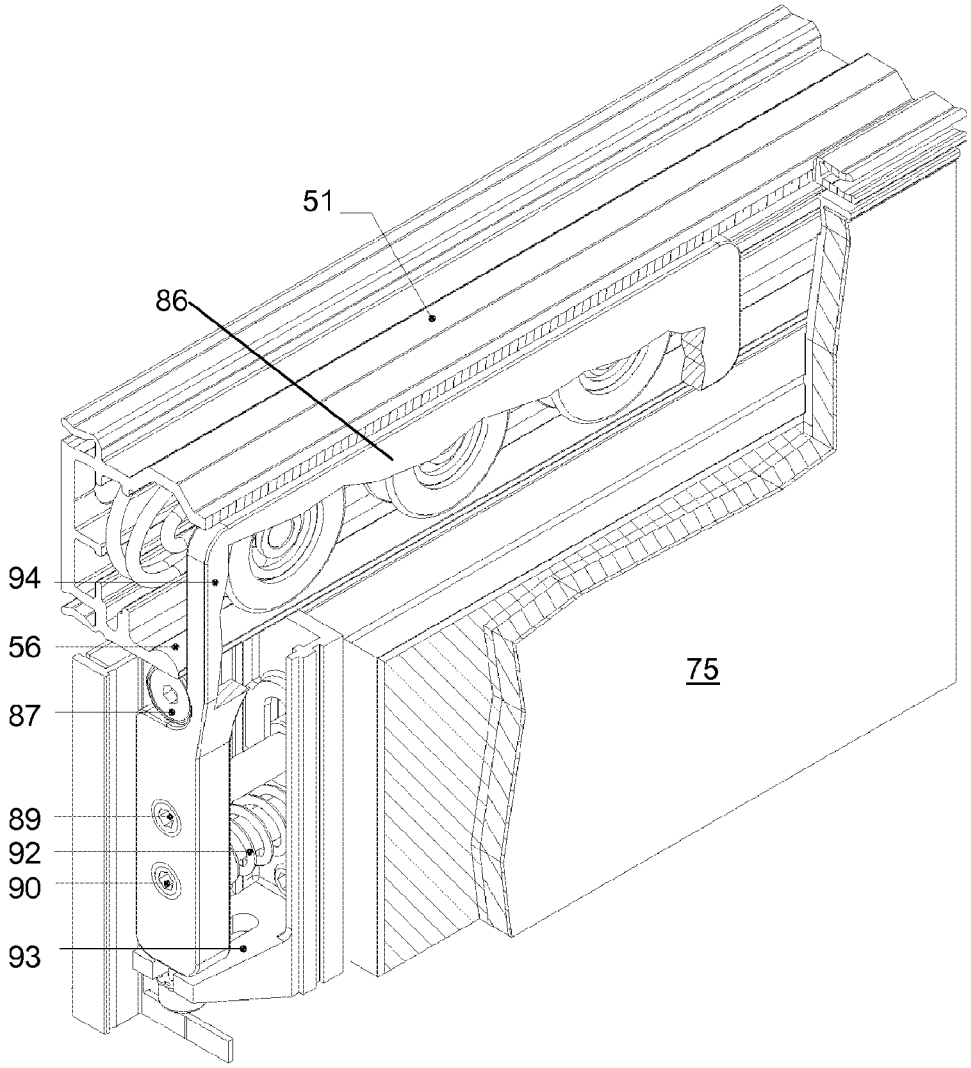
FIG. 33 shows a perspective view of a sliding door system according to the invention comprising the parts shown in FIGS. 21-28.

The positioning means are carried out as follows. The suspension block 86 comprises a first member 94 on which the suspension wheels 76, 84 are mounted and a second member 93 to which the sliding door is fixed by means of a screw 91. A horizontal screw 89 and a vertical screw 95 fix the two members to each other. In the second member 93, these screws 89, 95 extend through oblong slots, enabling the adjustment in height and length direction and also tilting the members 93, 94 with respect to each other to a given extent. The two members 93, 94 further enclose a compression spring 92 extending in length direction over another screw 90. This compression spring 92 functions as a positioning aid which counteracts the tendency of the first member 94 of the suspension block to tilt downwards as a result of the weight of the sliding door as long as the positioning screws are loosened during the installation stage. So this compression spring 92 can help to make sure that all the inline wheels 76, 84 will in the end be in contact with the rail system 51 and suspend the sliding door 75. The screws 89, 90 and 95 are operable from the side of the sliding door, as shown in FIG. 33.

The suspension block 86 further comprises a tilt prevention means for preventing tilting of the sliding door upon being pushed by a user. In particular, this tilt prevention means comprises a removable screw 87 having a wide head portion 88 which protrudes upwardly and is in use located in close proximity of the bottom side of the rail system 51, see FIG. 33.

Figure 31:
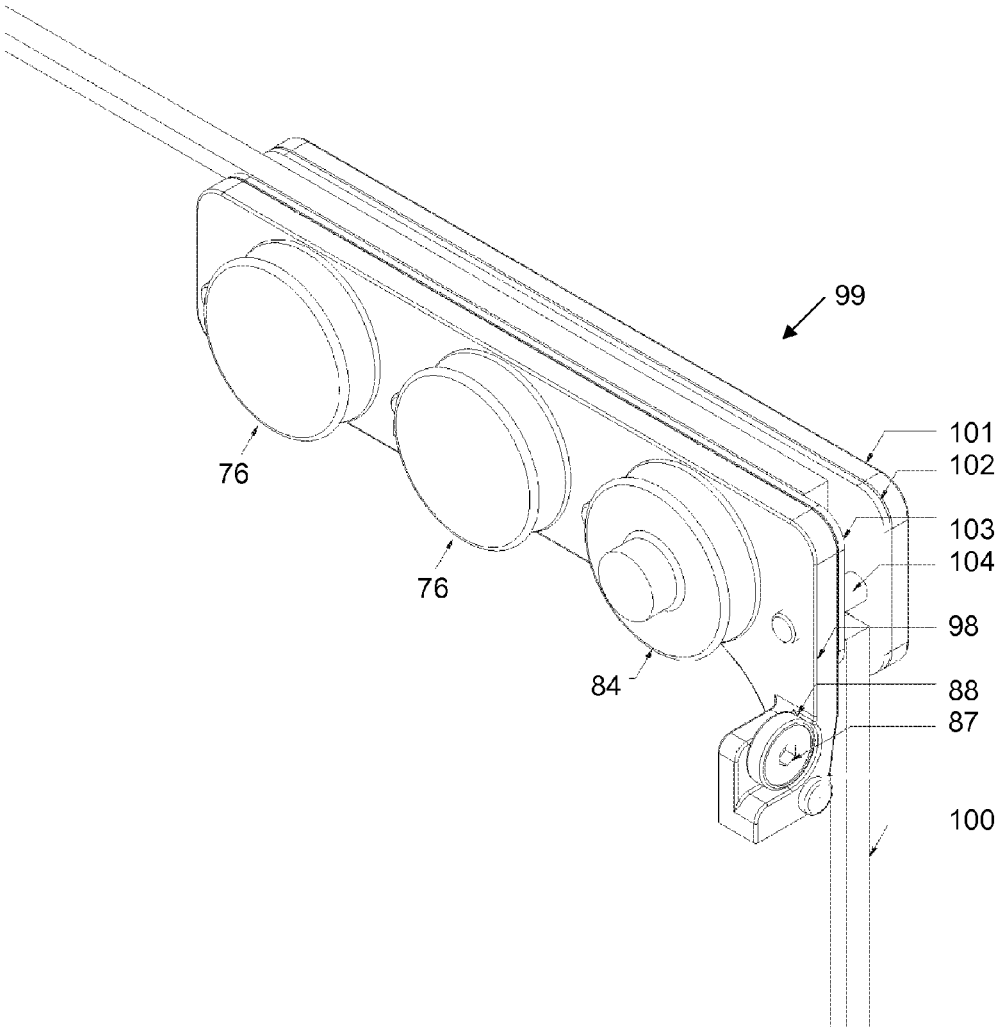
Figure 32:
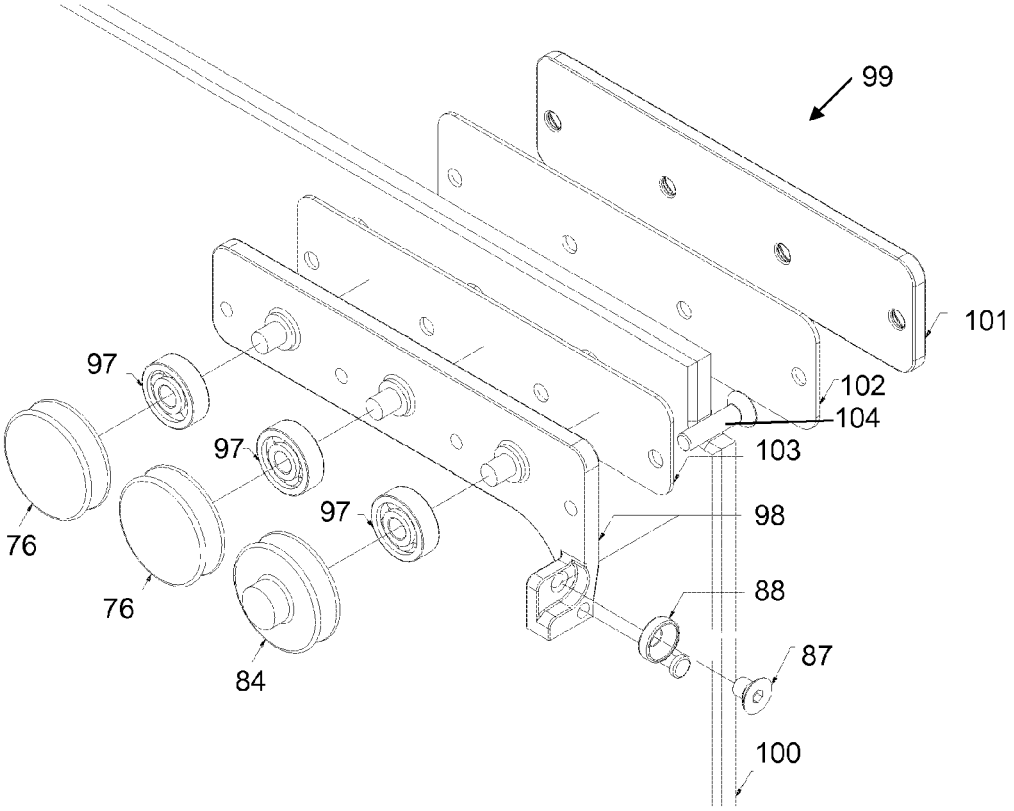

FIGS. 31 and 32 show an alternative embodiment of a suspension block 99 which is adapted for suspending a glass panel 100. The suspension block 99 is composed of a first part 98 which carries the inline wheels 76, 84 with ball bearings 97, a counterpart 101 which is mounted on the opposite side of the panel 100 and grip plates 102, 103 in between the parts 98, 101 and the glass panel 100. The whole is held together by means of bolts 104. Here too, the tilt prevention screw 87 with wide head portion 88 is provided.

Figure 34:
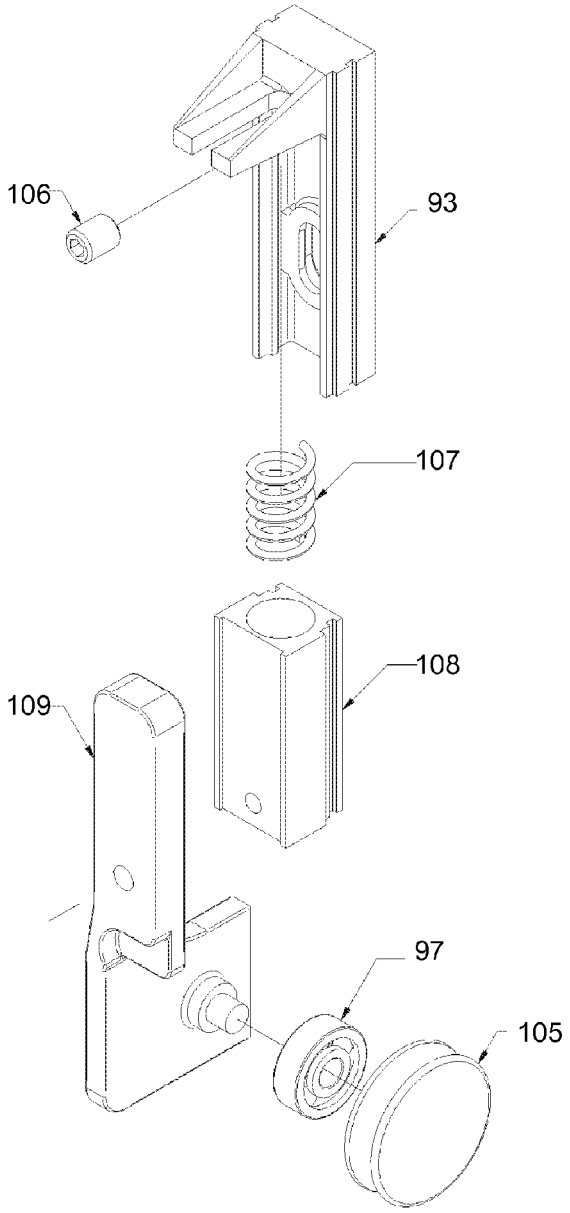
FIGS. 34 and 35 respectively show an exploded view and a perspective view of a wobble prevention means of a sliding door system according to the invention.
Figure 35:
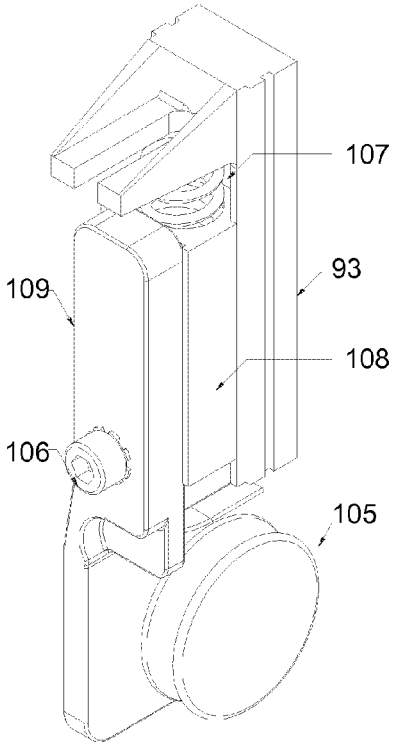

FIGS. 34 and 35 show a construction which is present at the bottom side of the sliding door 75 to prevent wobbling. This wobble prevention means is comprised of a first member 109 carrying a ball bearing 97 and a wheel 105 and a second member 93, which is the same construction part as in the suspension block 86 and therefore is given the same reference number. The second member 93 is fixed to the bottom side of the door. Between these two members 93, 109 a vertically extending spring 107 is held in a block 108 which can slide vertically in the second member 93. The first member 109 is fixed to this block by means of a screw 106. The result is that the running wheel 105, which can run on a guide rail or simply on the floor, is resiliently mounted on the bottom side of the sliding door 75, giving the door more stability while differences in the gap underneath the sliding door 75 can be overcome.

What is claimed:

1. A modular rail system for suspending sliding doors, comprising a plurality of rail profiles and a plurality of complementary spacer elements, wherein the plurality of complementary spacer elements comprises a plurality of oblong slats of different widths for defining the distance from a first of the rail profiles to a horizontal wall part and from the first rail profile to a second of the rail profiles, wherein each of the rail profiles comprises:

a top side having a first flat portion arranged for being fixed against a horizontal wall part, a bottom side having a rail portion for carrying suspension wheels of a sliding door, a first lateral side connecting the top side to the bottom side and having a second flat portion arranged for being fixed against a vertical wall part, an open second lateral side opposite the first lateral side a first recess at a first corner formed by the top side and the first lateral side, a second recess at a second corner formed by the top side and the second lateral side, and a third recess at a third corner formed by the first lateral side and the bottom side, wherein said first, second and third recesses extend generally parallel to the top side of the rail profile and have substantially the same shape, so that each of said recesses is arranged for engaging any one of said plurality of oblong slats, and wherein one side of each recess is formed by a resilient wing which is shaped for exerting a clamping force on the inserted slat, the wing having a reduced wall thickness at its base where it is connected to the profile, so that the wing can slightly bend away upon insertion of one of the slats and that after insertion the wing holds the inserted slat clamped firmly in position.

2. A modular rail system according to claim 1, wherein the thickness of the oblong slats corresponds to the height of the recesses.

3. A modular rail system according to claim 1, wherein each rail profile is provided with grooves for slidably holding a repositionable braking or stopping element for defining an extreme position of the sliding door.

4. A sliding door system for installation in a gap between two adjacent walls for closing off a door opening in front of the gap, comprising:

a modular rail system, comprising a plurality of rail profiles and a plurality of complementary spacer elements, wherein the plurality of complementary spacer elements comprises a plurality of oblong slats of different widths for defining the distance from a first of the rail profiles to a horizontal wall part and from the first rail profile to a second of the rail profiles, wherein each of the rail profiles comprises:

a top side having a first flat portion arranged for being fixed against a horizontal wall part, a bottom side having a rail portion for carrying suspension wheels of a sliding door, a first lateral side connecting the top side to the bottom side and having a second flat portion arranged for being fixed against a vertical wall part, an open second lateral side opposite the first lateral side, a first recess at a first corner formed by the tope side and the first lateral side, a second recess at a second corner formed by the top side and the second lateral side, and a third recess at a third corner formed by the first lateral side and the bottom side, wherein said first, second and third recesses extend generally parallel to the top side of the rail profile and have substantially the same shape, so that each of said recesses is arranged for engaging any one of said plurality of oblong slats, and wherein one side of each recess is formed by a resilient wing which is shaped for exerting a clamping force on the inserted slat, the wing having a reduced wall thickness at its base where it is connected to the profile, so that the wing can slightly bend away upon insertion of one of the slats and that after insertion the wing holds the inserted slat clamped firmly in position;

sliding doors with suspension wheels for suspending the sliding doors in the rail system, and at least one repositionable braking or stopping element comprising a stop for defining an extreme position of one of the sliding doors and a releasable fixing element for fixing the braking or stopping element in the rail system, wherein the fixing element is spaced a predetermined distance from the stop.

5. A sliding door system according to claim 4, wherein the braking or stopping element further comprises a brake for slowing down movement of the sliding door before hitting the stop.

6. A sliding door system according to claim 5, wherein the braking or stopping element comprises a bent metal wire which is shaped for being slidably mounted in corresponding grooves in the rail system, the bent metal wire having a first part forming the stop, a second part forming the brake and a third part holding the releasable fixing element.

7. A sliding door system according to claim 5, wherein the braking or stopping element comprises a central part holding the stop and the fixing element and comprising brakes in the form of leaf springs on opposite sides.

8. A sliding door system according to claim 7, wherein the stop is adjustably mounted on the central part for fine-tuning the extreme positions of the sliding door.

9. A sliding door system according to claim 4, wherein the suspension wheels are formed by inline wheels on a suspension block to which the sliding door is fixed, the suspension block being provided with positioning means for fine-tuning the position of the inline wheels with respect to the sliding door, such that all inline wheels remain in contact with the rail system.

10. A sliding door system according to claim 9, wherein the positioning means enable position adjustments both in height and length direction of the sliding door.

11. A sliding door system according to claim 9, wherein the positioning means comprise a compression spring as a positioning aid, the compression spring extending in length direction of the sliding door between a first member on which the inline wheels are mounted and a second member to which the sliding door is fixed.

12. A sliding door system according to claim 9, wherein at least one of the inline wheels comprises a protrusion for contacting the brake and/or the stop of the braking or stopping element.

13. A sliding door system according to claim 9, wherein the suspension block comprises a plurality of selectively extendable or retractable protrusions, spaced apart from each other in length direction of the sliding door, for contacting the stop of the braking or stopping element.

14. A sliding door system according to claim 9, wherein the suspension block is constructed such that in cross direction of the sliding door the inline wheels are located substantially in the middle of the sliding door.

15. A sliding door system according to claim 4, wherein the sliding door comprises a wobble prevention means at the bottom for preventing wobbling of the sliding door.

16. A sliding door system according to claim 15, wherein the wobble prevention means comprises a resiliently mounted running wheel.

17. A modular rail system according to claim 1, wherein the distance between the first rail profile and the horizontal wall part is defined by two of said oblong slats of equal width inserted in the first and third recesses on the first lateral side of the first rail profile, and wherein the distance between the first rail profile and the second rail profile is defined by a third of said oblong slats inserted in the second recess on the second lateral side of the first rail profile and in the first recess on the first lateral side of the second rail profile.

18. A sliding door system according to claim 4, wherein the distance between the first rail profile and the horizontal wall part is defined by two of said oblong slats of equal width inserted in the first and third recesses on the first lateral side of the first rail profile, and wherein the distance between the first rail profile and the second rail profile is defined by a third of said oblong slats inserted in the second recess on the second lateral side of the first rail profile and in the first recess on the first lateal side of the second rail profile.

* * * * *